US010161411B1

(12) United States Patent
Gottschalk et al.

(10) Patent No.: US 10,161,411 B1
(45) Date of Patent: Dec. 25, 2018

(54) CENTRIFUGAL PUMP SEALING SURFACES

(71) Applicant: Halliburton Energy Services, Inc., Houston, TX (US)

(72) Inventors: Thomas John Gottschalk, Houston, TX (US); Wesley John Nowitzki, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/789,175

(22) Filed: Oct. 20, 2017

(51) Int. Cl.

| | |
|---|---|
| ***F04D 29/16*** | (2006.01) |
| ***F04D 29/44*** | (2006.01) |
| ***F04D 29/22*** | (2006.01) |
| ***F04D 1/06*** | (2006.01) |

(52) U.S. Cl.
CPC ..... *F04D 29/16* (2013.01); *F04D 1/06* (2013.01); *F04D 29/22* (2013.01); *F04D 29/44* (2013.01)

(58) Field of Classification Search
CPC ..... F04D 1/04; F04D 1/06; F04D 1/10; F04D 1/14; F04D 7/02; F04D 29/16; F04D 29/162; F04D 29/167; F04D 29/2266; F04D 29/44; F05B 2240/33; F05B 2240/57; F05B 2260/30; F16J 15/447; F16J 15/4472; F16J 15/4476
See application file for complete search history.

(56) References Cited

U.S. PATENT DOCUMENTS

| | | | |
|---|---|---|---|
| 1,448,925 A | 3/1923 | Fulton et al. | |
| 1,642,914 A | 9/1927 | Whann | |
| 2,066,505 A * | 1/1937 | Wolfe | F04D 29/167 210/513 |
| 2,236,953 A | 4/1941 | Schott | |
| 2,271,336 A | 1/1942 | Goldsmith | |

(Continued)

FOREIGN PATENT DOCUMENTS

| | | |
|---|---|---|
| CN | 102606490 A | 7/2012 |

OTHER PUBLICATIONS

Takacs, Gabor, Electrical Submersible Pumps Manual: Design, Operations, and Maintenance, 2009, Gulf Professional Publishing, Burlington, MA, 9-118, 109 pages.

(Continued)

*Primary Examiner* — Richard Edgar
*Assistant Examiner* — Alexander White
(74) *Attorney, Agent, or Firm* — McGuireWoods LLP

(57) ABSTRACT

Centrifugal pump sealing surfaces are described. A multi-stage centrifugal pump includes an impeller between a first diffuser and a second diffuser, a plurality of sealing surfaces formed by at least one diffuser inlet ring of the first diffuser interspersed between at least two concentric balance rings of the impeller, and at least one annular diffuser exit skirt of the second diffuser interspersed between at least two concentric annular skirts of the impeller. A multi-stage centrifugal pump includes an impeller including a plurality of concentric annular impeller sealing surfaces mated to a plurality of concentric annular diffuser sealing surfaces, the diffuser sealing surfaces extending toward the impeller from a diffuser stacked adjacent to the impeller, wherein the impeller sealing surfaces and the diffuser sealing surfaces interlock to form a plurality of tight clearances and a tortuous leak path for well fluid lifted by the centrifugal pump.

17 Claims, 8 Drawing Sheets

(56) References Cited

U.S. PATENT DOCUMENTS

| | | | | |
|---|---|---|---|---|
| 3,215,083 | A | 11/1965 | Sarles et al. | |
| 3,265,001 | A | 8/1966 | Deters | |
| 3,402,671 | A * | 9/1968 | Wilfley | F04D 29/146 277/347 |
| 3,404,924 | A | 10/1968 | Choate | |
| 3,516,757 | A * | 6/1970 | Baumann | F03B 11/006 415/1 |
| 4,781,531 | A | 11/1988 | James | |
| 4,838,758 | A | 6/1989 | Sheth | |
| 5,184,945 | A | 2/1993 | Chi-Wei | |
| 5,667,314 | A | 9/1997 | Limanowka et al. | |
| 5,722,812 | A | 3/1998 | Knox et al. | |
| 5,765,950 | A | 6/1998 | Eno et al. | |
| 6,017,184 | A | 1/2000 | Aguilar et al. | |
| 6,068,444 | A | 5/2000 | Sheth | |
| 6,106,224 | A | 8/2000 | Sheth et al. | |
| 6,309,174 | B1 | 10/2001 | Oklejas, Jr. et al. | |
| 7,530,391 | B2 | 5/2009 | Hall et al. | |
| 7,549,837 | B2 | 6/2009 | Hackworth et al. | |
| 7,575,413 | B2 | 8/2009 | Semple et al. | |
| 7,670,056 | B2 | 3/2010 | Petitjean et al. | |
| 7,909,090 | B2 | 3/2011 | Reid | |
| 8,066,476 | B2 | 11/2011 | Orban et al. | |
| 8,070,426 | B2 | 12/2011 | Brunner et al. | |
| 8,287,235 | B2 | 10/2012 | Orban et al. | |
| 8,337,142 | B2 | 12/2012 | Eslinger et al. | |
| 8,400,035 | B2 | 3/2013 | Watson | |
| 8,491,277 | B2 | 7/2013 | Kawabata et al. | |
| 8,568,081 | B2 | 10/2013 | Song et al. | |
| 8,651,836 | B2 | 2/2014 | Parmeter et al. | |
| 8,684,679 | B2 | 4/2014 | Tetzlaff et al. | |
| 8,801,360 | B2 | 8/2014 | Sheth et al. | |
| 9,039,356 | B1 | 5/2015 | Nowitzki et al. | |
| 9,200,642 | B2 | 12/2015 | Nowitzki et al. | |
| 9,638,207 | B2 | 5/2017 | Jayaram et al. | |
| 9,677,560 | B1 | 6/2017 | Davis et al. | |
| 2004/0057642 | A1 | 3/2004 | New | |
| 2012/0020777 | A1 | 1/2012 | Eslinger | |
| 2013/0017075 | A1 | 1/2013 | Orban et al. | |
| 2013/0209225 | A1 | 8/2013 | Eslinger | |
| 2013/0319956 | A1 | 12/2013 | Tetzlaff et al. | |
| 2014/0030055 | A1 | 1/2014 | Jayaram et al. | |
| 2015/0023815 | A1 | 1/2015 | Tetzlaff et al. | |
| 2015/0152877 | A1 | 6/2015 | Jayaram et al. | |

OTHER PUBLICATIONS

American Petroleum Institute, Centrifugal Pumps for Petroleum, Petrochemical and Natural Gas Industries, ANSI/API Standard 610, 11th Edition, Sep. 2010, 218 pages.

* cited by examiner

CENTRIFUGAL PUMP SEALING SURFACES

BACKGROUND OF THE INVENTION

1. Field of the Invention

Embodiments of the invention described herein pertain to the field of multi-stage centrifugal pumps for artificial lift. More particularly, but not by way of limitation, one or more embodiments of the invention enable improved centrifugal pump sealing surfaces.

2. Description of the Related Art

Fluid, such as gas, oil or water, is often located in underground formations. When pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser. A rotating shaft runs through the central hub of the impeller, and the impeller is keyed to the shaft such that the impeller rotates with the shaft. A motor below the pump turns the shaft. In ESP assemblies, the multistage centrifugal pump is included in an ESP system that includes an ESP motor, motor protector and intake below the pump, and production tubing above the pump.

Each rotating impeller and stationary diffuser pair is called a "stage." Each stage uses a rotating impeller to impart kinetic energy to the fluid and a static diffuser to convert the kinetic energy into lift. In multi-stage centrifugal pumps, multiple stages of impeller and diffuser pairs may be used to further increase the pressure lift. The stages are stacked around the pump's shaft, with each successive impeller sitting on a diffuser of the previous stage. Conventionally, each impeller has two cylindrical surfaces that are designed to be in very close proximity to mating surfaces on the diffusers. The two cylindrical surfaces are known to those of skill in the art of electric submersible pumps as a skirt and a balance ring.

FIG. 1 illustrates a conventional stage of the prior art. Conventional skirt 100 extends axially on the bottom of the impeller. The conventional skirt 100 wear ring rotates inside the conventional diffuser exit skirt 105. The close conventional clearance 110 between conventional skirt 100 and conventional diffuser exit skirt 105 provides a hydraulic seal to restrict fluid from leaking back to the eye of the impeller when fluid is pumped. The hydraulic seal helps to increase volumetric efficiency, maintain desired performance and assist with radial stabilization. A conventional phenolic washer is held in place between conventional skirt 100 and retainer 125. The phenolic washer prevents contact in an axial direction between conventional diffuser exit skirt 105 and the impeller above.

Impellers also have a conventional balance ring 115 extending axially on the top side of the impeller. Conventional balance ring 115 rotates inside the conventional diffuser inlet 120. A second close conventional clearance 110 extends between conventional impeller balance ring 115 and conventional diffuser inlet 120. During operation of the pump, a hydraulic seal forms within the space between the conventional balance ring 115 and the conventional diffuser inlet 120 and provides radial support to the pump.

The controlled clearances between the skirt and the diffuser, and between the balance ring and the diffuser, create a hydraulic seal to ensure that most of the fluid exiting from the impeller continues on through the diffuser instead of recirculating back into the eye of impeller. Larger percentages of fluid that is recirculated leads to lower the efficiency and lifting capacity of the pump. To be effective, conventional clearances 110 should be less than 0.022 inches diametrically.

A problem that arises is that underground formations contain well born solids, such as consolidated and unconsolidated sand that is carried through the pump with the production fluid. Over time, sand and other solids abrade the impeller balance ring, impeller skirt and corresponding diffuser sealing surfaces. This abrasive wear increases the conventional clearances 110, reducing performance. FIG. 2 illustrates an impeller with a conventional balance ring 115 and conventional skirt 100 that typically abrade from exposure to well-born solids. Clearances exceeding about 0.022 inches diametrically result in significantly reduced pump efficiency and capacity, as well as reduced radial stabilization.

As is apparent from the above, currently available centrifugal pumps are not well suited to operation in sandy environments due to abrasive wear to surfaces forming controlled clearances. Therefore, there is a need for improved centrifugal pump sealing surfaces that can withstand abrasive environments.

BRIEF SUMMARY OF THE INVENTION

One or more embodiments of the invention enable centrifugal pump sealing surfaces.

Centrifugal pump sealing surfaces are described. An illustrative embodiment of a multi-stage centrifugal pump includes an impeller between a first diffuser and a second diffuser, and a plurality of sealing surfaces formed by at least one diffuser inlet ring of the first diffuser interspersed between at least two concentric balance rings of the impeller, and at least one annular diffuser exit skirt of the second diffuser interspersed between at least two concentric annular skirts of the impeller. In some embodiments, one of the at least one annular diffuser exit skirts includes a lip extending around an innermost impeller skirt of the at least two concentric annular skirts of the impeller. In certain embodiments, the lip angles around a bottom portion of the innermost impeller skirt. In some embodiments, the lip slants opposite and parallel to a slanted inner diameter of the innermost impeller skirt. In certain embodiments, the multi-stage centrifugal pump further includes at least two annular diffuser exit skirts, the at least two annular diffuser exit skirts arranged concentrically around a longitudinal axis of the centrifugal pump. In some embodiments, the plurality of sealing surfaces form a leak path diverging from a primary fluid passageway of the multi-stage centrifugal pump, the primary fluid passageway extending around vanes of the impeller and continuing through production tubing coupled to the multi-stage centrifugal pump. In certain embodiments, the at least two concentric balance rings of the impeller extend upward from a first shroud of the impeller, and the at least two concentric annular skirts of the impeller extend downwards from a second shroud of the impeller, and the vanes extend between the first shroud and the second shroud. In some embodiments, a tight clearance extends between an inner diameter of the diffuser inlet ring and an outer diameter of a first concentric balance ring of the at least two concentric balance rings, and a second tight clearance extends between an outer diameter of the diffuser inlet ring and an inner diameter of a second concentric balance ring of the at least two concentric balance rings.

An illustrative embodiment of a multi-stage centrifugal pump includes a rotatable impeller, the rotatable impeller including a plurality of concentric annular impeller sealing surfaces, the plurality of concentric annular impeller sealing surfaces mated to a plurality of concentric annular diffuser sealing surfaces, the plurality of concentric annular diffuser sealing surfaces extending toward the rotatable impeller from a diffuser stacked adjacent to the rotatable impeller, wherein the plurality of concentric annular impeller sealing surfaces and the plurality of concentric annular diffuser sealing surfaces interlock to form a plurality of tight clearances therebetween, and wherein the plurality of tight clearances form a tortuous leak path for well fluid lifted by the multi-stage centrifugal pump. In some embodiments, the plurality of concentric annular impeller sealing surfaces are one of impeller skirts or impeller balance rings. In certain embodiments, an innermost concentric annular diffuser sealing surface of the plurality of concentric annular diffuser sealing surfaces includes a flow mitigating lip, the flow mitigating lip extending around an innermost concentric annular impeller sealing surface of the plurality of concentric annular impeller sealing surfaces. In some embodiments, the innermost concentric annular impeller sealing surface and the innermost concentric annular diffuser sealing surface define an outer wall of a primary fluid lift passageway. In certain embodiments, an outer diameter of the flow mitigating lip slants opposite and parallel to a slanted inner diameter of the innermost concentric annular impeller sealing surface. In some embodiments, the plurality of concentric annular impeller sealing surfaces are impeller skirts extending downward from a shroud, and the plurality of concentric annular diffuser sealing surfaces are diffuser skirts extending upwards from a flow exit of the diffuser towards the rotatable impeller. In certain embodiments, the plurality of concentric annular impeller sealing surfaces are impeller balance rings extending upwards from an impeller shroud, and the plurality of concentric annular diffuser sealing surfaces are rings extending downward from a flow inlet of the diffuser towards the rotatable impeller.

An illustrative embodiment of a multi-stage centrifugal pump includes an impeller mated to a first diffuser and seated above a second diffuser, the second diffuser including an annular diffuser exit skirt extending axially toward the impeller, the impeller including a pair of annular impeller skirts, wherein a first impeller skirt of the pair of annular impeller skirts extends inward of the annular diffuser exit skirt with a first clearance therebetween, and wherein a second impeller skirt of the pair of annular impeller skirts extends outward of the diffuser exit skirt with a second clearance therebetween. In some embodiments, the multi-stage centrifugal pump further includes an annular lip protruding from the diffuser exit skirt, the annular lip extending around a bottom of the first impeller skirt and forming a third clearance therebetween. In some embodiments, the first clearance, the second clearance and the third clearance together form a tortuous path for fluid flow. In certain embodiments, the first diffuser includes a diffuser inlet ring extending downward toward the impeller, the impeller including a pair of annular balance rings, wherein a first balance ring of the pair of annular balance rings extends inward of the of the diffuser inlet ring with a fourth clearance therebetween, and wherein a second balance ring of the pair of annular balance rings extends outward of the diffuser inlet ring with a fifth clearance therebetween. In certain embodiments, the fourth clearance and the fifth clearance together create a tortuous path for fluid flow.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
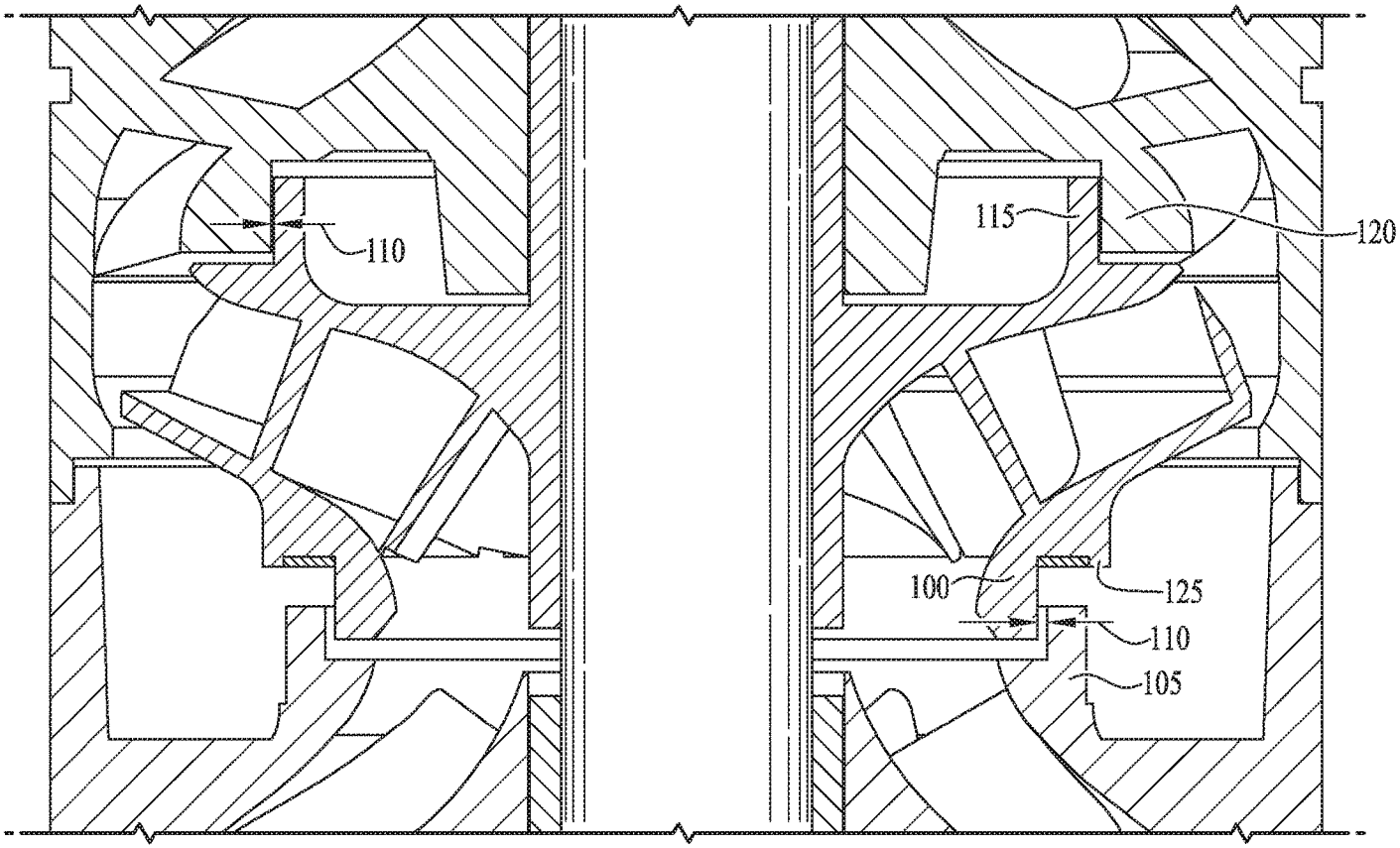
FIG. 1 PRIOR ART
FIG. 1 is a cross-sectional view of conventional sealing surfaces of the prior art.
Figure 2:
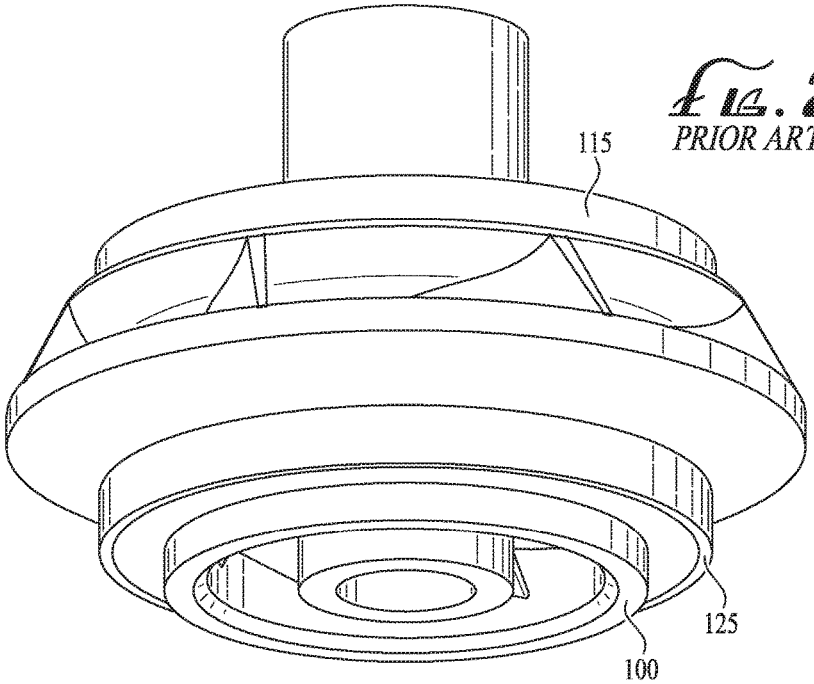
FIG. 2 PRIOR ART
FIG. 2 is a perspective view of an impeller of the prior art.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

Centrifugal pump sealing surfaces are described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a "clearance" includes one or more clearances.

"Coupled" refers to either a direct connection or an indirect connection (e.g., at least one intervening connection) between one or more objects or components. The phrase "directly attached" means a direct connection between objects or components.

As used herein, the term "outer," "outside" or "outward" mean the radial direction away from the center of the shaft of the electric submersible pump (ESP) assembly component and/or the opening of a component through which the shaft would extend. In the art, the "outer diameter" is used to refer to the outer circumference or outer surface of an annular object, such as a skirt or ring.

As used herein, the term "inner", "inside" or "inward" means the radial direction toward the center of the shaft of the ESP assembly component and/or the opening of a component through which the shaft would extend. In the art, the "inner diameter" is used to refer to the inner circumference or inner surface of an annular object, such as a skirt or ring.

As used herein the terms "axial", "axially", "longitudinal" and "longitudinally" refer interchangeably to the direction extending along the length of the shaft of an ESP assembly component such as a multi-stage centrifugal pump, gas separator or charge pump.

"Downstream" or "upwards" refer interchangeably to the longitudinal direction substantially with the principal flow of lifted fluid when the pump assembly is in operation. By way of example but not limitation, in a vertical downhole ESP assembly, the downstream direction may be towards the surface of the well. The "top" of an element refers to the downstream-most side of the element, without regard to whether the element is oriented horizontally, vertically or extends through a radius.

"Upstream" or "downwards" refer interchangeably to the longitudinal direction substantially opposite the principal flow of working fluid when the pump assembly is in operation. By way of example but not limitation, in a vertical downhole ESP assembly, the upstream direction may be opposite the surface of the well. The "bottom" of an element refers to the upstream-most side of the element, without regard to whether the element is oriented horizontally, vertically or extends through a radius.

As used in this specification and the appended claims, the terms "media," "abrasive media," "solids," "laden well fluid," "foreign solids," "abrasives," and "contaminants" refer interchangeably to sand, rock, rock particles, soils, proppant, slurries, and any other non-liquid, non-gaseous matter found in the fluid being pumped by the artificial lift pumping system.

As used herein, a "tight clearance" means a clearance of less than 0.022 inches diametrically.

For ease of description, illustrative embodiments described herein are described in terms of an ESP multi-stage centrifugal pump. However, illustrative embodiments may be equally applied to any centrifugal pump at risk of sustaining abrasive damage to sealing surfaces that form controlled clearances between an impeller and an adjacent and/or paired diffuser. For example, illustrative embodiments may be applied to stages inside axial-flow, radial-flow, and mixed-flow centrifugal pumps.

Illustrative embodiments provide multiple, concentric sealing surfaces, creating a more tortuous, labyrinth type leak path with greater surface area in seal locations in order to reduce fluid velocity through the leak path and encourage abrasives to bypass the seal areas. By reducing abrasives flowing through the seal surfaces, illustrative embodiments may maintain tight clearances, which may improve efficiency and lifting capacity of the pump. Illustrative embodiments may maintain minimal fluid leakage to provide hydrodynamic benefits to the centrifugal pump, while reducing and/or preventing abrasive damage to the tight clearances of the hydraulic seals.

Illustrative embodiments may be employed in one or more stages of a primary pump, charge pump or gas separator of an ESP assembly. An impeller of illustrative embodiments may include a plurality of concentric skirts, a plurality of concentric balance rings, or both. The plurality of impeller skirts may be interspersed between a plurality of diffuser exit skirts. The interspersion may be similar to the interlocking of gear teeth. The innermost diffuser exit skirt may include a lip protrusion that extends around the bottom of the innermost impeller skirt. Tight clearances may be formed between the inner and outer surfaces of the impeller skirts and the diffuser exit skirts. A diffuser inlet ring may be interspersed between the plurality of impeller balance rings. Tight clearances may be formed between the diffuser inlet ring and the impeller balance rings. The tight clearances may form a tortuous fluid leak path through the sealing surfaces, which may reduce fluid velocity through the sealing surfaces and discourage abrasive media from flowing through and undesirably abrading the sealing surfaces.

Figure 3A:
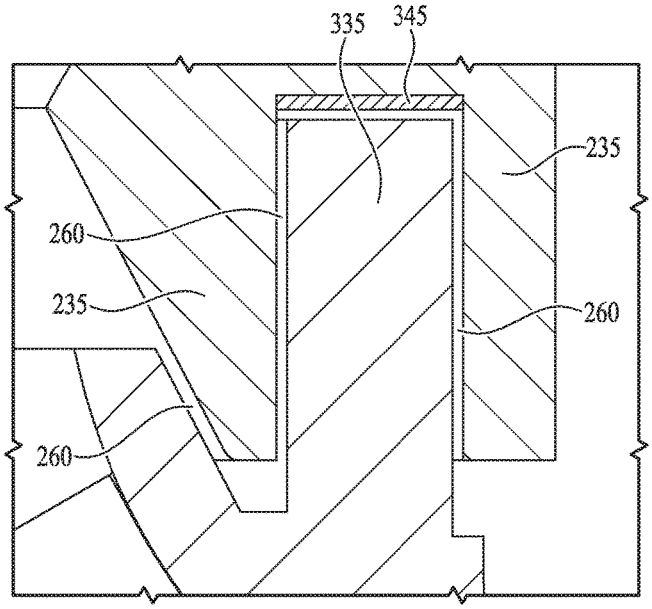
FIG. 3A is an enlarged view of cylindrical sealing surfaces of FIG. 3.
Figure 3:
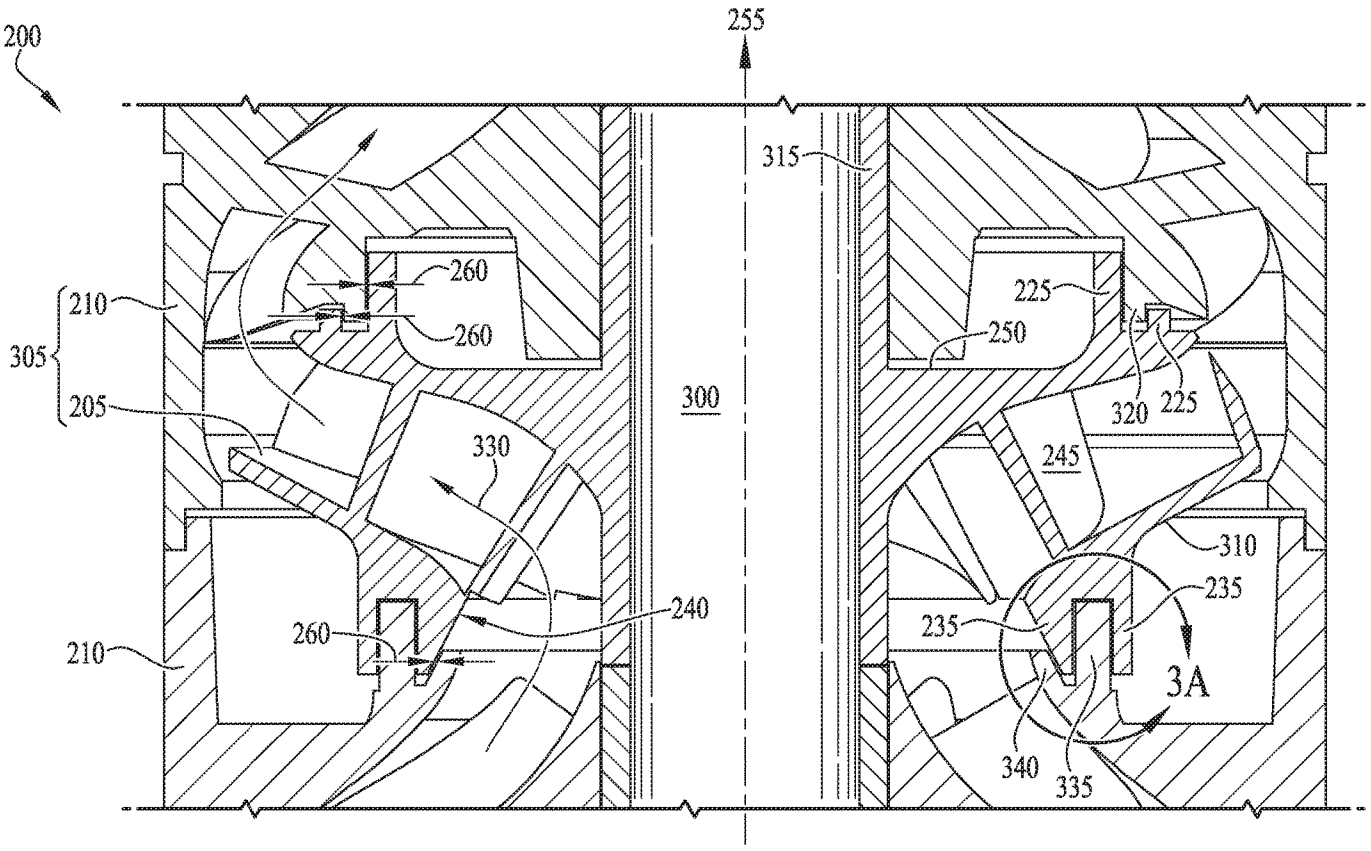
FIG. 3 is a cross sectional view of cylindrical sealing surfaces of an illustrative embodiment.

FIG. 3 shows an exemplary centrifugal pump having sealing surfaces of an illustrative embodiment. Centrifugal pump 200 may be a multi-stage centrifugal pump, with each stage 305 including an impeller 205 and diffuser 210 pair stacked around a drive shaft 300. Each impeller 205 may sit on a diffuser 210 of the previous stage 305. Impeller 205 may be keyed or otherwise coupled to shaft 300 at hub 315 and may rotate with shaft 300. Diffuser 210 may be a carrier that does not rotate. Impeller 205 may be fluidly coupled to diffusers 210 below and above impeller 205 such that fluid flows around the impeller vanes 245, through primary stage passageways 330 and is lifted upwards, for example to the surface of a well through production tubing coupled to centrifugal pump 200. Impeller 205 may be shrouded by upper shroud 250 and/or lower shroud 310. Upper shroud 250 may form the top side of impeller 205 and lower shroud 310 may form the bottom side of impeller 205. Vanes 245 may extend between upper shroud 250 and lower shroud 310. In some embodiments, impeller 205 may be an open impeller and lower shroud 310 may not be present.

A plurality of sealing surfaces may extend from upper shroud 250 and/or lower shroud 310. A plurality of balance rings 225 may extend from upper shroud 250. Balance rings 225 may be cylindrical and/or annular and extend axially from and/or perpendicularly to upper shroud 250, concentrically around shaft 300 and/or the longitudinal axis 255 of the pump. As shown in FIG. 3, two concentric balance rings 225 extend upward from upper shroud 250. The outermost balance ring 225 may be located at the periphery of upper shroud 250 of impeller 205. One or more inner balance rings 225 may be spaced concentrically inward from balance ring 225 at, near and/or proximate the outer periphery of upper shroud 250. Balance ring 225 may be a seal and/or wear ring that restricts (chokes) fluid flow to assist in preventing higher pressure fluid from impeller 205 discharge from recirculating back to the lower pressure impeller 205 intake area, and instead proceed downstream through primary stage passageways 330. Balance ring 225 may also dampen radial vibrations imparted by shaft 300 and/or impeller 205 imbalance so that shaft 300 deflection is minimized. Where upper shroud 250 includes balance holes 400 (shown in FIG. 4), balance rings 225 may be positioned on upper shroud 250 outward of balance holes.

Figure 7:
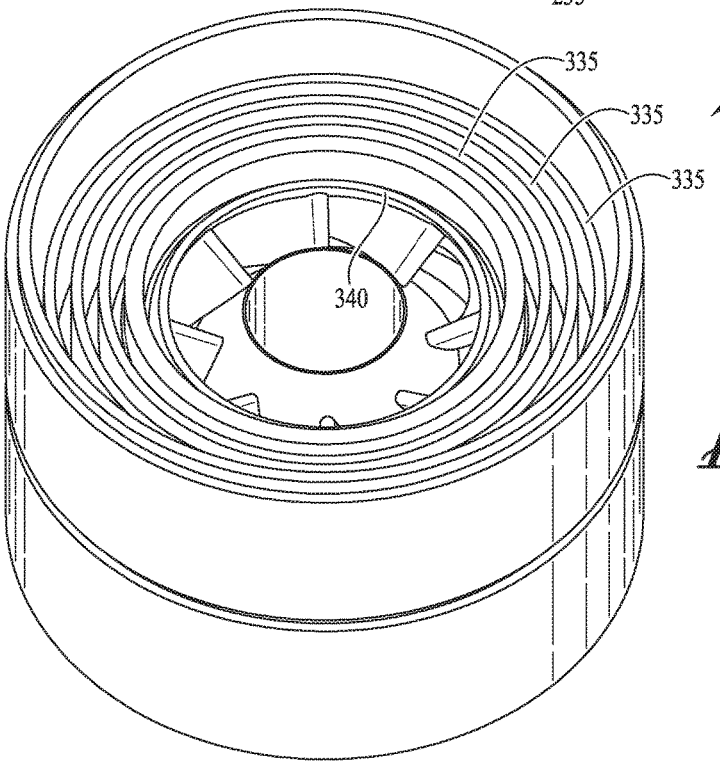
FIG. 7 is a perspective view of a diffuser of an illustrative embodiment.

Diffuser 210 mated with and/or above impeller 205 may include diffuser inlet ring 320. Diffuser inlet ring 320 may be an annularly extending rib or portion of diffuser 210 extending into the diffuser inlet toward impeller 205, outward of diffuser hub 325 and inward of primary stage passageways 330. FIG. 7 illustrates an exemplary diffuser having a plurality of diffuser inlet rings 320. Diffuser inlet ring 320 may extend into the space between two adjacent balance rings 225. Diffuser inlet ring 320 may interlock with balance rings 225 to form tight clearances 260 between diffuser inlet ring 320 and each of the balance rings 225. A first tight clearance 260 may be formed between the outer surface of diffuser inlet ring 320 and the inner surface of balance ring 225 located at shroud 250 periphery. A second tight clearance 260 may be formed between the inner surface of diffuser inlet ring 320 and the outer face of the adjacent balance ring 225. As may be appreciated by those of skill in the art, upper shroud 250 may include additional balance rings 225 and diffuser inlet rings 320 to form additional sealing surfaces and tight clearances 260. Although a small portion of lifted fluid may leak from primary stage passageways 330 through tight clearances 260, which fluid leakage may be hydrodynamically desirable, the tortuous pathway of peaks and troughs formed by balance rings 225 and diffuser inlet ring 320 may advantageously discourage abrasives to flow through tight clearances 260 thereby preventing abrasion of the sealing surfaces that form clearances 260.

Figure 6:
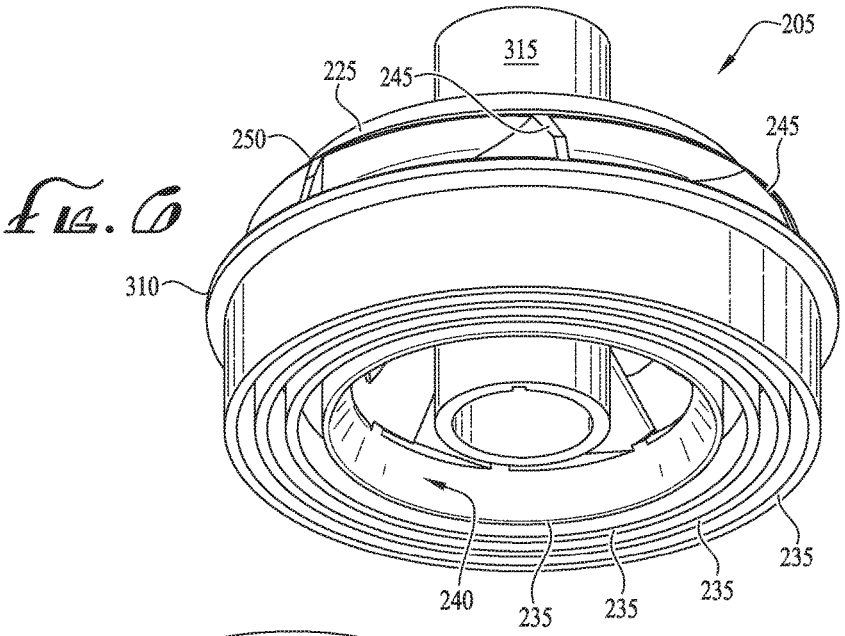
FIG. 6. is a perspective view of an impeller of an illustrative embodiment.

A plurality of impeller skirts 235 may extend from lower shroud 310, where lower shroud 310 is included on impeller 205. FIG. 6 illustrates an impeller 205 with a plurality of impeller skirts 235. Impeller skirts 235 may be cylindrical and/or annular wear rings on the bottom side of impeller 205. Impeller skirts 235 may be annular extensions (circular walls) extending axially from lower shroud 310 and encircling shaft 300 on the upstream side of impeller 205. Similarly to balance ring 225, skirt 235 may assist in dampening radial vibrations imparted by shaft 300 and stiffening. Skirts 235 may extend outward of primary stage passageways 330. As shown in FIG. 3, two impeller skirts 235 extend axially and concentrically from lower shroud 310 towards diffuser 210 of the previous stage and/or of the diffuser 210 below impeller 205. Impeller skirts 235 may be spaced radially apart from one another. Diffuser exit skirt 335 may be a ring that extends around the diffuser exit and into the space between adjacent impeller skirts 235. As shown in FIG. 3A, diffuser exit skirt 335 may intersperse snuggly into the space between impeller skirts 235 to form tight clearances 260 between the inner and outer faces of diffuser exit skirt 335 and the adjacent impeller skirts 235.

Figure 5:
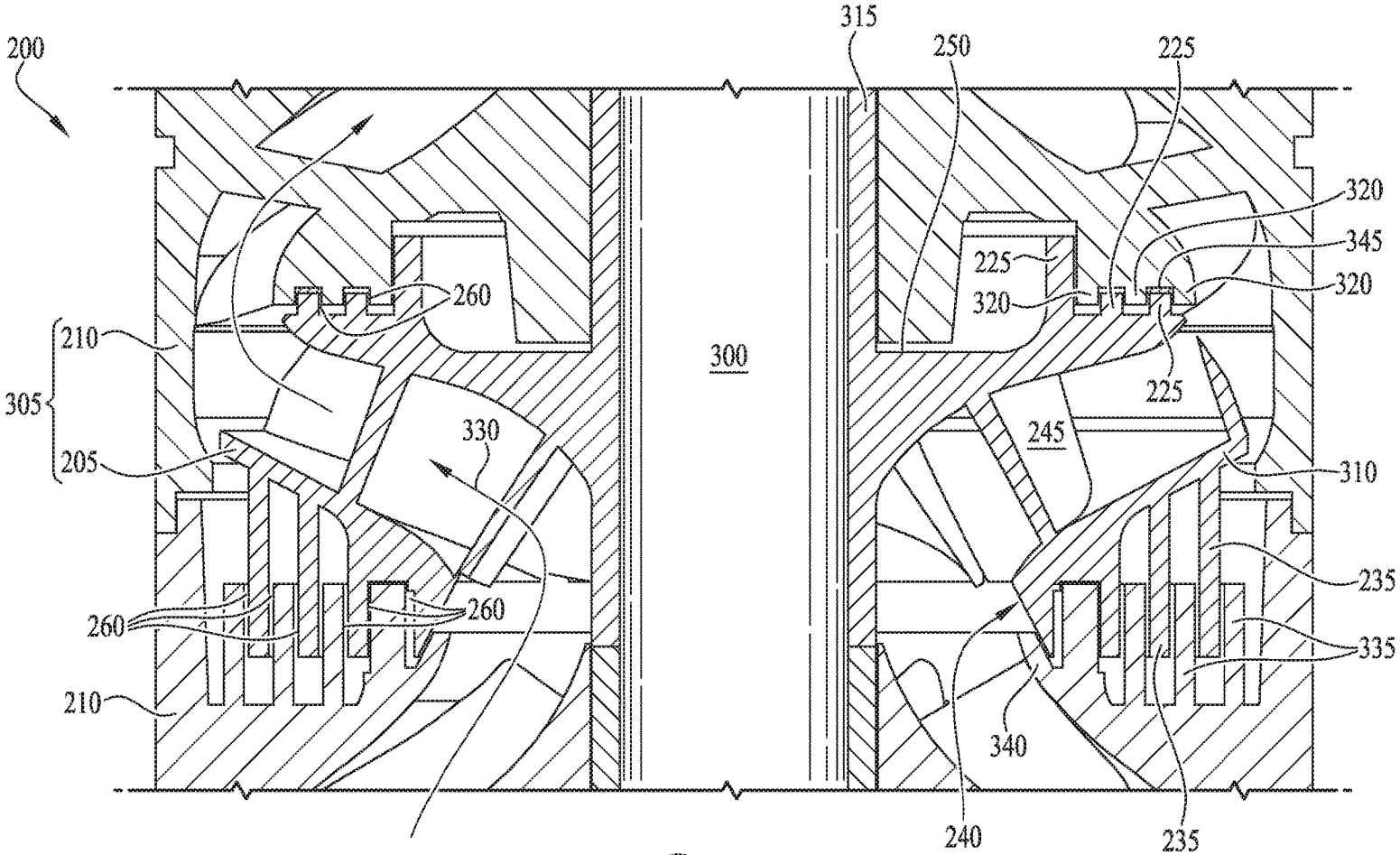
FIG. 5 is a cross sectional view of sealing surfaces of an illustrative embodiment.

Referring to FIG. 3A, a phenolic washer 345 may be placed between two adjacent impeller skirts 235, above diffuser exit skirt 335, to prevent metal-to-metal contact in the axial direction between the top of diffuser exit skirt 335 and the portion of impeller 205 above diffuser exit skirt 335. A single washer 345 may be employed in the space between the two adjacent impeller skirts 235 having the tightest axial clearance. As shown in FIG. 5, a similar washer may be placed between two adjacent balance rings 225, below diffuser inlet ring 320. In some embodiments, only a single phenolic washer 345 may be needed in each direction in the location of the tightest axial clearance.

Referring to FIG. 3 and FIG. 3A, the innermost diffuser exit skirt 335 may include and/or be adjacent to a protruding lip 340 that extends around the bottom portion of the innermost impeller skirt 235. Lip 340 may curve and/or slant as it extends upwards around impeller skirt 235. The innermost impeller skirt 235 may include skirt inner diameter 240 that angles outwards, as it extends downwards, to fit inside lip 340, with a tight clearance 260 between impeller skirt inner diameter 240 and lip 340. Lip 340 and the innermost impeller skirt 235 may define the portion of primary stage passageway 330 passing by lip 340 and serve to guide fluid from leak path 405 (shown in FIG. 4A) to rejoin primary stage passageway 330.

Diffuser lip 340 may extend upward from a base coupled to diffuser 210 and/or diffuser exit skirt 335, and extend around a bottom portion of innermost skirt 235. The outside diameter of diffuser lip 340 may have an angled surface extending upwards and inwards. The outside diameter of diffuser lip 340 may mirror, follow and/or match the slant of innermost skirt inner diameter 240 such that skirt inner diameter 240 mates inside lip 340, with a tight clearance 260 between them. The outer diameter of diffuser lip 340 may slope inwards as protrusion 340 extends downstream, mirroring or substantially mirroring the opposing sloped surface of innermost skirt inner diameter 240. Tight clearance 260 may separate the outside diameter of lip 340 from the skirt inner diameter 240 of the inner most impeller skirt 235. The inner diameter of lip 340 may be curved, angled and/or slanted to continue or substantially continue the curved shape of primary stage passage 330. Lip 340 may encourage abrasive media to bypass tight clearances 260 and/or the labyrinth of fluid leak path 405.

As shown in FIG. 3, where two impeller skirts 235 and one diffuser exit skirt 335 are included, three tight clearances 260 may be formed between the sealing surfaces of the impeller skirts 235, diffuser exit skirt 335 and lip 340. Impeller skirts 235 and diffuser exit skirts 335 may form a tortuous leak path 405 including peaks, troughs and turns that together discourage fluid to leak through.

Figure 4:
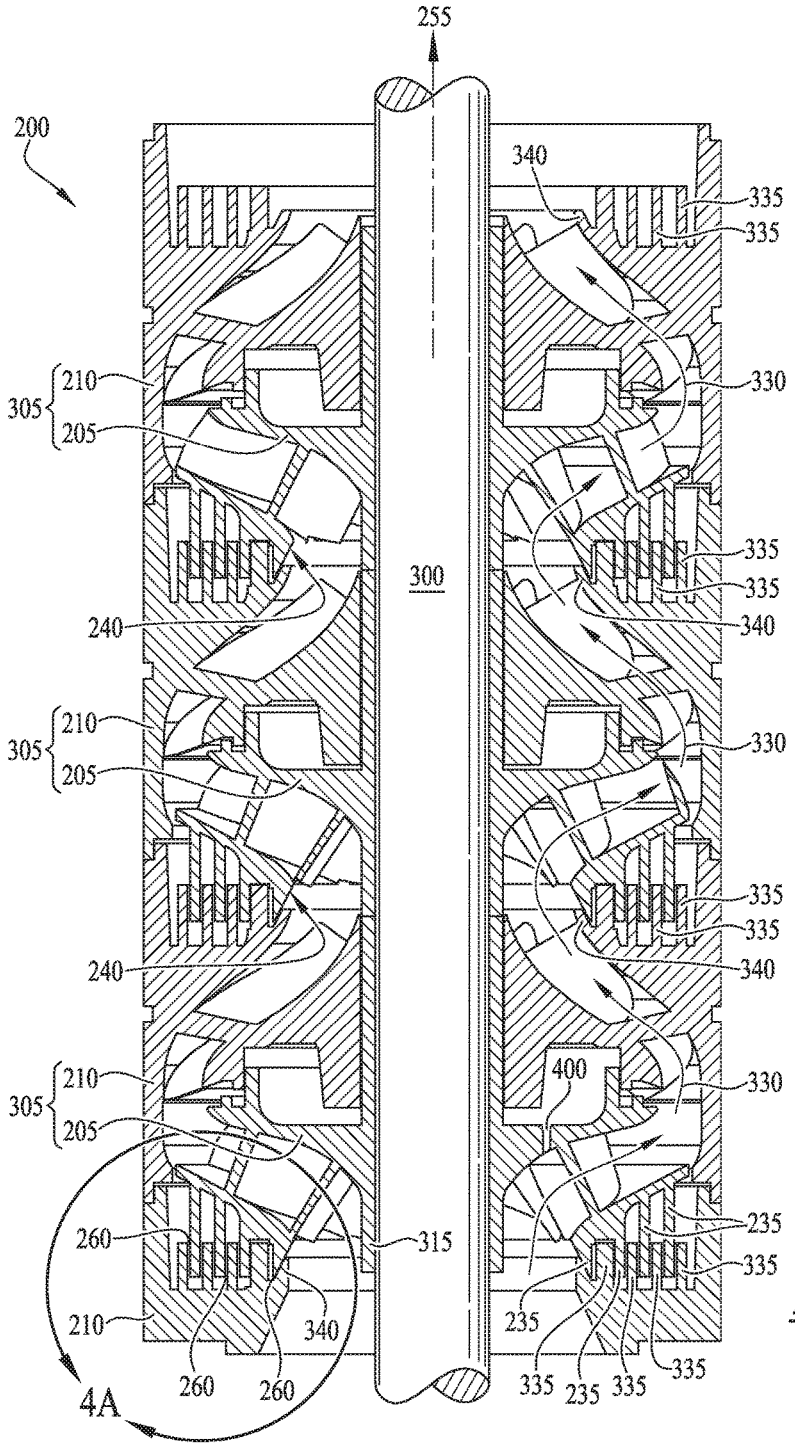
FIG. 4 is a cross sectional view of a multi-stage centrifugal pump of an illustrative embodiment.
Figure 4A:
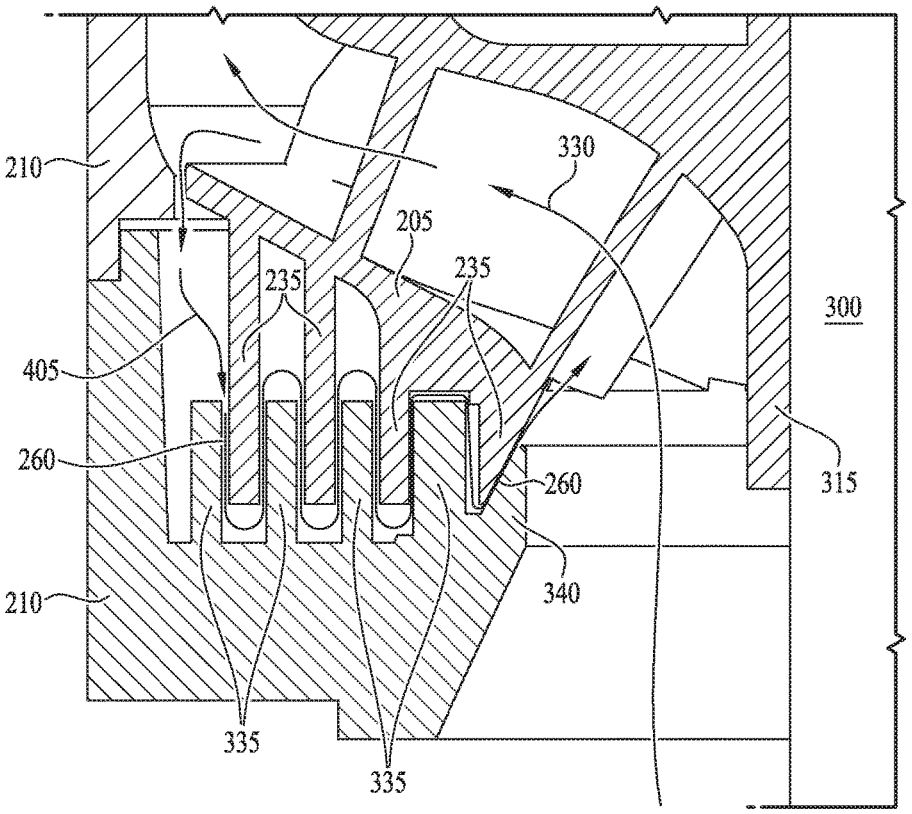
FIG. 4A is an enlarged view of the multi-stage centrifugal pump of FIG. 4.

FIG. 4 and FIG. 4A illustrate an exemplary series of impeller skirts 235 and diffuser exit skirts 335, interspersed between one another to form a series of tight clearances 260 between the sealing surfaces. In FIG. 4, four impeller skirts 235 and four diffuser exit skirts 335 are shown, in addition to lip 340, forming eight tight clearances between the impeller 205 and diffuser 210 sealing surfaces. Turning to FIG. 4A, impeller skirts 235 and diffuser exit skirts 335 may be interlocked (with space for clearances 260), similarly to teeth of gears. Leak pathway 405 formed around and/or between the skirts 235, 335 may be maze-like containing several turns, peaks and/or troughs that may prevent abrasive solids from flowing through leak pathway 405, and the abrasives may instead continue on through primary stage passageway 330. Tight clearances 260 may be fluidly coupled to one another, for example through the space above each diffuser exit skirt 335 and/or the space below each impeller skirt 235. Such a configuration of alternating impeller skirts 235 with diffuser exit skirts 335 may form a tortuous leak path from ESP centrifugal pump 200 stages 305 on the bottom of impeller 205. In this way, tight clearances 260 may form a labyrinth leak pathway 405, which leak pathway 405 may discourage the flow of abrasive media through leak path 405, instead directing abrasive media out of the pump through primary fluid passageway 330. A similar leak pathway 405 may be formed at the top of impeller 205 around and between balance rings 225 and diffuser inlet rings 320.

Each tight clearance 260 may preferably be held at or between 0.012-0.016 inches diametrically in some embodiments, but should be less than 0.022 inches diametrically.

During operation of the centrifugal pump, impeller 205 may rotate within diffuser 210. As fluid is lifted, at least a portion of the well fluid flowing through primary stage passageways 330 may be diverted through tight clearances 260 and/or leak pathway 405 and form hydraulic seals in each tight clearance 260. As shown in FIG. 4A, fluid may flow through tight clearances 260 by falling down around the outer diameter of lower shroud 310, continuing through the maze-like leak path 405 between opposing impeller 205 and diffuser 210 sealing surfaces before passing between skirt inner diameter 240 and lip 340 and rejoining primary fluid passageway 330. In order to leak through the series of hydraulic seals of illustrative embodiments, the well fluid must undergo several successive changes in direction, for example alternating between upstream and downstream to traverse two or more successive tight clearances 260 fluidly coupled in series. In this way, tight clearances 260 may reduce the fluid velocity through the seals and, as a result, may discourage abrasives from entering tight clearances 260. By reducing the quantity and/or rate of abrasives entering the hydraulic seals, the tightness of tight clearances 260 may be retained, which may prevent operation-limiting damage to the pump 200 and/or ESP assembly 800 as a result of seal surface erosion. Further, several additional impeller balance rings 225 and/or skirts 235 may be employed to elongate the tortuous leak paths of the series of tight clearances 260 and thus enhance the abrasive-reducing capabilities of illustrative embodiments.

Illustrative embodiments may employ two or more impeller skirts 235, two or more balance rings 225, or two or more impeller skirts 235 and two or more balance rings 225. FIG. 5 illustrates an embodiment having three balance rings 225 mated with three diffuser inlet rings 320, and four impeller skirts 235 mated with four diffuser exit skirts 335 and lip 340.

Figure 8:
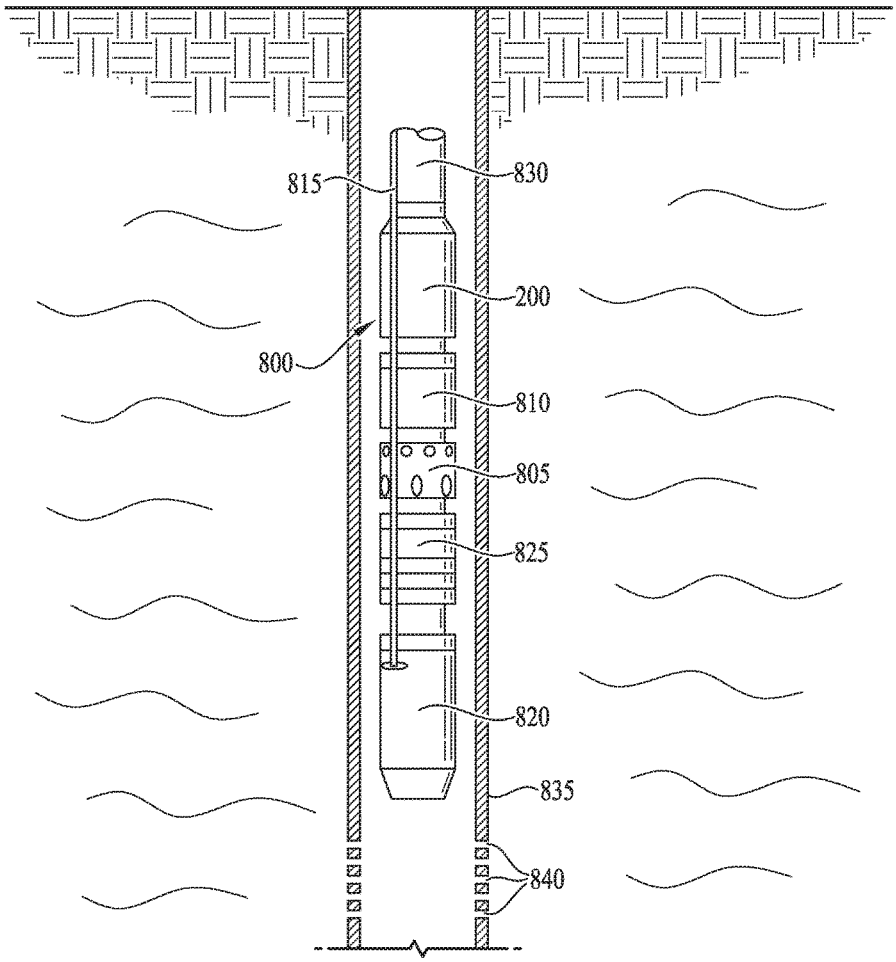
FIG. 8 is a perspective view of an electric submersible pump assembly having stages with sealing surfaces of illustrative embodiments.

FIG. 8 illustrates an exemplary ESP assembly employing the sealing surfaces of illustrative embodiments. Multistage centrifugal pump 200 may be situated in a downhole well, such as an oil or natural gas well. Fluid may enter casing 835 through perforations 840 in casing. Downhole well and/or ESP assembly 800 may be vertical, horizontal or operate within a bend or radius. Electric submersible motor 820 may operate to turn shaft 300 of centrifugal pump 200 and may be a two-pole, three phase squirrel cage induction motor. Power cable 815 may provide power to motor from a power source located at the surface of the well. In gaseous wells, gas separator 805 and/or tandem charge pump 810 may be included in ESP assembly and may also include stages 305 of illustrative embodiments. Gas separator 805 may serve as the intake for fluid into centrifugal pump 200. Seal section 825 may equalize pressure in motor 820 and keep well fluid from entering motor 820. Production tubing 830 may carry lifted fluid to the surface of the well.

Illustrative embodiments may reduce abrasive damage in an ESP primary pump 200, charge pump 810 or gas separator 805 by employing one or more tortuous leak paths 405 through a series of tight clearances 260 formed by a plurality of sealing surfaces including multiple balance rings 225, multiple skirts 235, or both. The tortuous leak path 405 may reduce the fluid velocity of leaking well fluid, which may discourage abrasive media from entering and abrading the tight clearances 260 forming the hydraulic seals. Each hydraulic seal may be formed when a seal surface of an impeller 205 is mated with a corresponding seal surface of a diffuser 210, which seal surfaces may be separated from one another by a tight clearance 260. The plurality of hydraulic seals may be formed at the top of the impeller 205 by mating a series of concentric impeller balance rings 225 with one or more diffuser inlet rings 320. A plurality of hydraulic seals may be formed at the bottom of the impeller 205 by mating a series of concentric impeller skirts 235 with one or more corresponding diffuser exit skirts 335. Illustrative embodiments may include a flow mitigating lip seal inside the innermost skirt 235 at the fluid transition from diffuser 210 to impeller 205, which flow mitigating seal may be formed by mating a sloped inner diameter 240 of the impeller skirt 235 with a diffuser lip 340.

Improved centrifugal pump sealing surfaces have been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A multi-stage centrifugal pump comprising:

an impeller between a first diffuser and a second diffuser; and a plurality of sealing surfaces formed by:

at least one diffuser inlet ring of the first diffuser interspersed between at least two concentric balance rings of the impeller; and at least one annular diffuser exit skirt of the second diffuser interspersed between at least two concentric annular skirts of the impeller; and wherein one of the at least one annular diffuser exit skirts comprises a lip extending around an innermost impeller skirt of the at least two concentric annular skirts of the impeller.

2. The multi-stage centrifugal pump of claim 1, wherein the lip angles around a bottom portion of the innermost impeller skirt.

3. The multi-stage centrifugal pump of claim 1, wherein the lip slants opposite and parallel to a slanted inner diameter of the innermost impeller skirt.

4. The multi-stage centrifugal pump of claim 1, comprising at least two annular diffuser exit skirts, the at least two annular diffuser exit skirts arranged concentrically around a longitudinal axis of the centrifugal pump.

5. The multi-stage centrifugal pump of claim 1, wherein the plurality of sealing surfaces form a leak path diverging from a primary fluid passageway of the multi-stage centrifugal pump, the primary fluid passageway extending around vanes of the impeller and continuing through production tubing coupled to the multi-stage centrifugal pump.

6. The multi-stage centrifugal pump of claim 1, wherein the at least two concentric balance rings of the impeller extend upward from a first shroud of the impeller, and the at least two concentric annular skirts of the impeller extend downwards from a second shroud of the impeller, and vanes extend between the first shroud and the second shroud.

7. The multi-stage centrifugal pump of claim 1, wherein a tight clearance extends between an inner diameter of the at least one diffuser inlet ring and an outer diameter of a first concentric balance ring of the at least two concentric balance rings, and a second tight clearance extends between an outer diameter of the at least one diffuser inlet ring and an inner diameter of a second concentric balance ring of the at least two concentric balance rings.

8. A multi-stage centrifugal pump comprising:

a rotatable impeller, the rotatable impeller comprising a plurality of concentric annular impeller sealing surfaces, the plurality of concentric annular impeller sealing surfaces mated to a plurality of concentric annular diffuser sealing surfaces;

the plurality of concentric annular diffuser sealing surfaces extending toward the rotatable impeller from a diffuser stacked adjacent to the rotatable impeller;

wherein the plurality of concentric annular impeller sealing surfaces and the plurality of concentric annular diffuser sealing surfaces interlock to form a plurality of tight clearances therebetween;

wherein the plurality of tight clearances form a tortuous leak path for well fluid lifted by the multi-stage centrifugal pump; and wherein an innermost concentric annular diffuser sealing surface of the plurality of concentric annular diffuser sealing surfaces comprises a flow mitigating lip, the flow mitigating lip extending around an innermost concentric annular impeller sealing surface of the plurality of concentric annular impeller sealing surfaces.

9. The multi-stage centrifugal pump of claim 8, wherein the plurality of concentric annular impeller sealing surfaces are one of impeller skirts or impeller balance rings.

10. The multi-stage centrifugal pump of claim 8, wherein the innermost concentric annular impeller sealing surface and the innermost concentric annular diffuser sealing surface define an outer wall of a primary fluid lift passageway.

11. The multi-stage centrifugal pump of claim 8, wherein an outer diameter of the flow mitigating lip slants opposite and parallel to a slanted inner diameter of the innermost concentric annular impeller sealing surface.

12. The multi-stage centrifugal pump of claim 8, wherein the plurality of concentric annular impeller sealing surfaces are impeller skirts extending downward from a shroud, and the plurality of concentric annular diffuser sealing surfaces are diffuser skirts extending upwards from a flow exit of the diffuser towards the rotatable impeller.

13. The multi-stage centrifugal pump of claim 8, wherein the plurality of concentric annular impeller sealing surfaces are impeller balance rings extending upwards from an impeller shroud, and the plurality of concentric annular diffuser sealing surfaces are rings extending downward from a flow inlet of the diffuser towards the rotatable impeller.

14. A multi-stage centrifugal pump comprising:

an impeller mated to a first diffuser and seated above a second diffuser;

the second diffuser comprising an annular diffuser exit skirt extending axially toward the impeller;

the impeller comprising a pair of annular impeller skirts, wherein a first impeller skirt of the pair of annular impeller skirts extends inward of the annular diffuser exit skirt with a first clearance therebetween, wherein a second impeller skirt of the pair of annular impeller skirts extends outward of the diffuser exit skirt with a second clearance therebetween; and an annular lip protruding from the diffuser exit skirt, the annular lip extending around the first impeller skirt and forming a third clearance therebetween.

15. The multi-stage centrifugal pump of claim 14, wherein the first clearance, the second clearance and the third clearance together form a tortuous path for fluid flow.

16. The multi-stage centrifugal pump of claim 14, further comprising:

the first diffuser comprising a diffuser inlet ring extending downward toward the impeller;

the impeller comprising a pair of annular balance rings, wherein a first balance ring of the pair of annular balance rings extends inward of the diffuser inlet ring with a fourth clearance therebetween, and wherein a second balance ring of the pair of annular balance rings extends outward of the diffuser inlet ring with a fifth clearance therebetween.

17. The multi-stage centrifugal pump of claim 16, wherein the fourth clearance and the fifth clearance together create a tortuous path for fluid flow.

* * * * *